US007129902B2

(12) United States Patent
Bancroft

(10) Patent No.: US 7,129,902 B2
(45) Date of Patent: Oct. 31, 2006

(54) DUAL SLOT RADIATOR SINGLE FEEDPOINT PRINTED CIRCUIT BOARD ANTENNA

(75) Inventor: Randy Bancroft, Denver, CO (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/906,184

(22) Filed: Feb. 7, 2005

(65) Prior Publication Data

US 2005/0200545 A1 Sep. 15, 2005

Related U.S. Application Data

(60) Provisional application No. 60/566,911, filed on Apr. 30, 2004, provisional application No. 60/552,933, filed on Mar. 12, 2004.

(51) Int. Cl.
*H01Q 13/10* (2006.01)
*H01Q 1/38* (2006.01)

(52) U.S. Cl. ..... 343/767; 343/700 MS

(58) Field of Classification Search ..... 343/767, 343/770, 700 MS
See application file for complete search history.

(56) References Cited

U.S. PATENT DOCUMENTS

| | | | | |
|---|---|---|---|---|
| 4,792,809 | A * | 12/1988 | Gilbert et al. | 343/770 |
| 5,068,670 | A * | 11/1991 | Maoz | 343/767 |
| 5,489,913 | A * | 2/1996 | Raguenet et al. | 343/767 |
| 5,646,637 | A * | 7/1997 | Miller | 343/713 |
| 6,388,621 | B1 * | 5/2002 | Lynch | 343/700 MS |
| 6,677,909 | B1 * | 1/2004 | Sun et al. | 343/767 |
| 6,781,546 | B1 * | 8/2004 | Wang et al. | 343/700 MS |
| 6,844,853 | B1 * | 1/2005 | Tai et al. | 343/700 MS |
| 6,847,329 | B1 * | 1/2005 | Ikegaya et al. | 343/702 |
| 6,861,986 | B1 * | 3/2005 | Fang et al. | 343/700 MS |
| 6,864,841 | B1 * | 3/2005 | Dai et al. | 343/700 MS |

* cited by examiner

*Primary Examiner*—Don Wong
*Assistant Examiner*—Marie Antoinette Cabucos
(74) *Attorney, Agent, or Firm*—Holland & Hart LLP

(57) ABSTRACT

A dual slot radiator is provided. The dual slot radiator comprises two slot radiating elements of different lengths having a single power feed. The power feed generally comprises a microstrip feed line connected at a first end to a power source and each of the slot radiators at a second end.

20 Claims, 3 Drawing Sheets

DUAL SLOT RADIATOR SINGLE FEEDPOINT PRINTED CIRCUIT BOARD ANTENNA

RELATED APPLICATIONS

This application claims priority to U.S. Provisional Applications 60/552,933, filed Mar. 12, 2004, and 60/566,911, filed Apr. 30, 2004, titled the same, and incorporated herein as if set out in full.

FIELD OF THE INVENTION

The present invention relates to antennas and, more particularly, dual frequency printed circuit board antennas.

BACKGROUND OF THE INVENTION

Printed circuit board antennas are generally known in the art. FIG. 1 shows a prior art style printed circuit board antenna 100. This antenna has a substrate 102, a ground plane 104, a microstrip line 106, a radiating slot 108, and a shorting strip 110. While antenna 100 functions well enough it has several drawbacks. Some of the drawbacks include single frequency operation and the microstrip line 106 for a power feed at the slot center.

Thus, it would be desirous to provide an improved printed circuit board antenna having dual frequency operation and improved power feed.

SUMMARY OF THE INVENTION

To attain the advantages and in accordance with the present invention, a multiband antenna is provided. The multiband antenna comprises a ground plane with a first slot radiator of a first length and a second slot radiator of a second length, the first and second slot radiators have first and second feed ends, and first and second terminating ends, respectively. A single power feed extends from a source end attached to a power source to a radiator end. The radiator end has a first branch connected the radiator and a second branch connected to the second radiator. The two radiators may be of different lengths to facilitate multi-frequencies of operation.

The foregoing and other features, utilities and advantages of the invention will be apparent from the following more particular description of a preferred embodiment of the invention as illustrated in the accompanying drawings.

DETAILED DESCRIPTION

The present invention will now be explained with reference to FIGS. 2–5. While FIGS. 2–5 show embodiments of the present invention, one of ordinary skill in the art on reading the disclosure will understand different arrangements, configurations, and dimensions are possible and the configuration shown in FIGS. 2–5 should be considered exemplary and not limiting.

Figure 1:
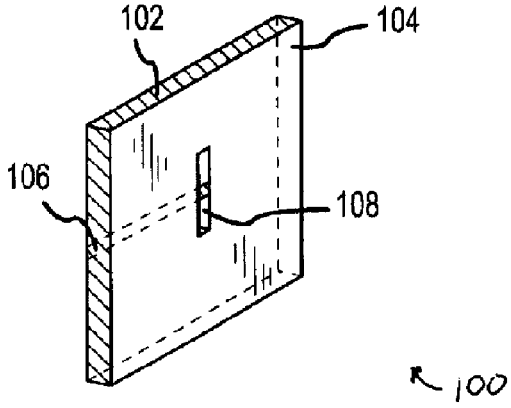
FIG.1 (PRIOR ART)
FIG. 1 is a simplified diagram of a prior art antenna.
Figure 2:
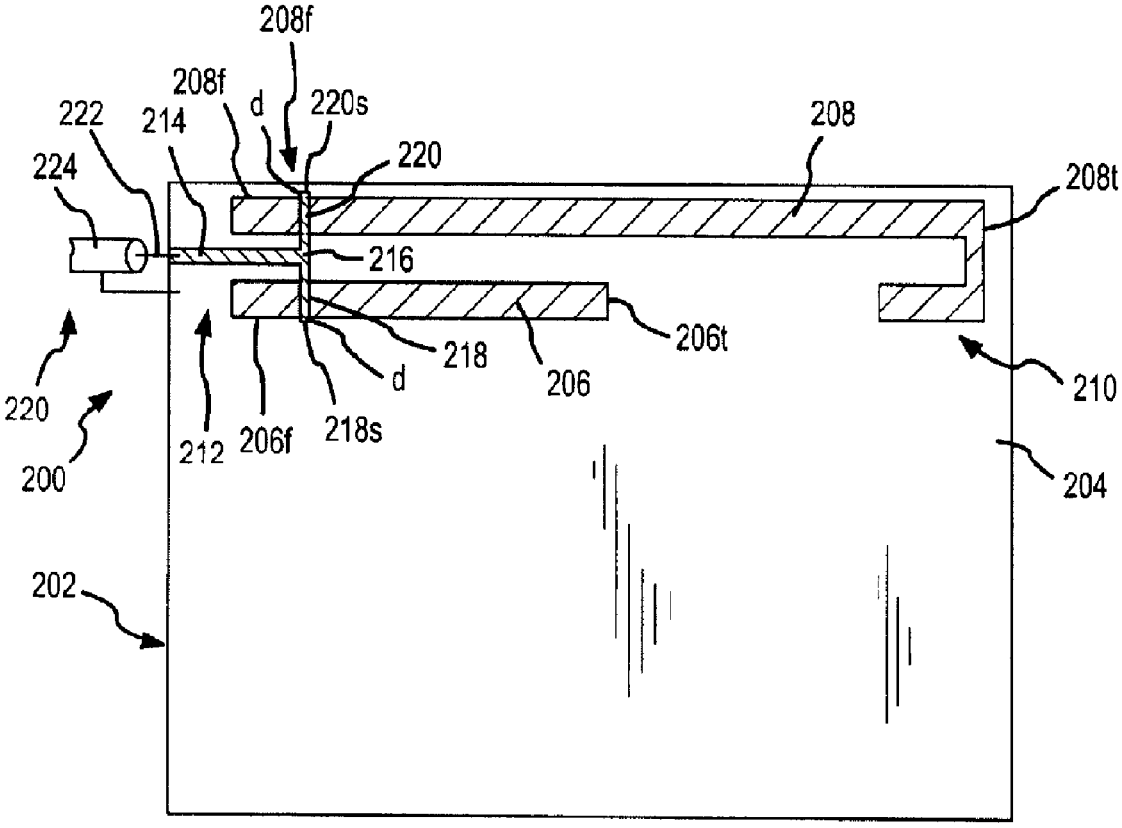
FIG. 2 is a simplified diagram of an antenna consistent with an embodiment of the present invention.

FIG. 2 shows a printed circuit board antenna 200 consistent with an embodiment of the present invention. Antenna 200 is shown on a substrate 202, but substrate 202 is not necessary for the present invention. When included, substrate 202 is a dielectric material. Antenna 200 comprises a ground plane 204, a first radiating element 206, and a second radiating element 208. First radiating element has a feed end 206*f* and a terminating end 206*t*. Second radiating element has a feed end 208*f* and a terminating end 208*t*.

First radiating element 206 and second radiating element 208 may be straight radiating elements or have zigzag, meanderline, curved, or the like geometries.

Second radiating element 208 has a L shaped portion 210 at terminating end 208*t*. L shaped portion 210 could have other configurations, such as a C shape, a curve, a straight or I shape, a step shape or the like. Radiating portion 206 could have an alternative configuration at terminating end 206*t* if desired.

A feed connection 212 is coupled to each first radiating element 206 and second radiating element 208 proximate or at feed end 206*f* and 208*f*. Feed connection 212 comprises a microstrip feed line 214 and a tee connection 216. Tee connection 216 has a first branch 218 terminating in a short 218*s* that shorts the tee connection to ground plane 204 and a second branch 220 terminating in a short 220*s* that shorts the tee connection to ground plane 204. Short 218*s* and short 220*s* reside proximate by a short distance d away from first radiating element 206 and second radiating element 208. Tee connection 216 could take other shapes, such as, a Y shape or the like.

A power feed 220 connects to the microstrip feed line 214. If power feed 220 was a coaxial cable power feed, a conductor 222 of coaxial cable would attach to microstrip feed line 214 and a jacket 224 or ground of coaxial cable would attach to ground plane 204. Placement of tee connection 216 allows for impedance matching. Further, while explained using a coaxial cable as the power feed 220, any conventional power feed is possible.

Figure 3:
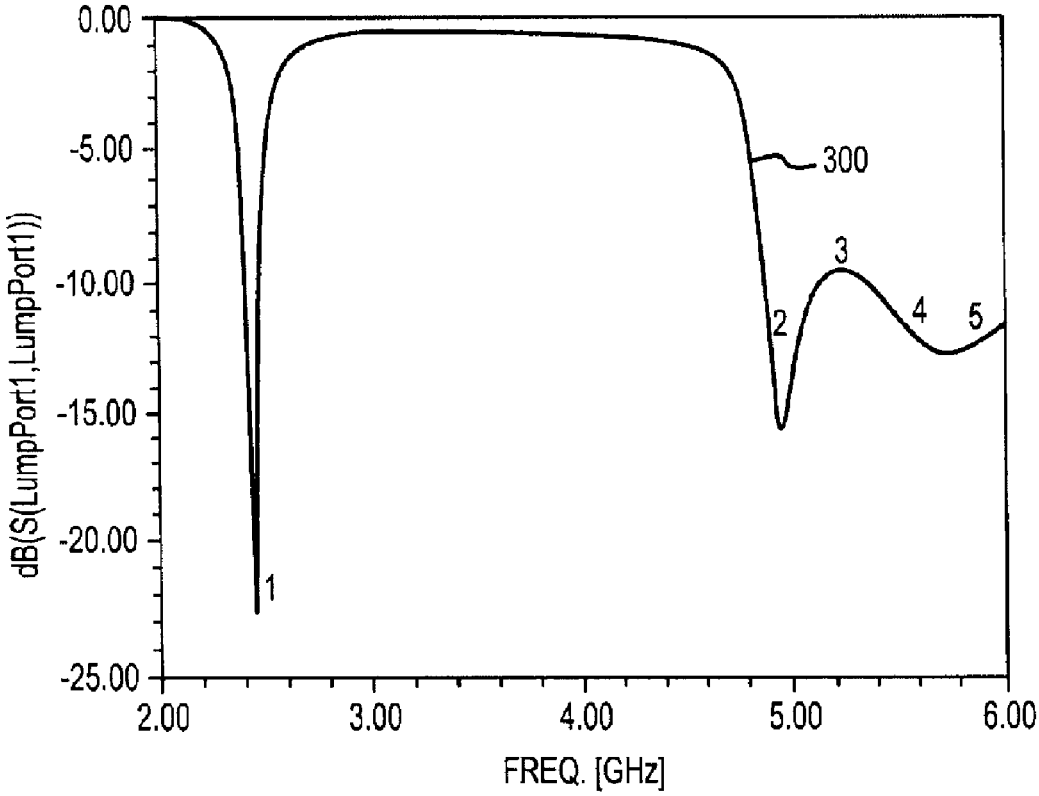
FIG. 3 is a frequency plot of an antenna constructed in accordance with an embodiment of the present invention.

In operation, first radiating element 206 (the shorter element) would operate at a higher frequency and second radiating element 208 (the longer element) would operate at a lower frequency. The elements could be tuned by varying the configuration, dimensions, and the like of each element. FIG. 3 shows a possible frequency response of an antenna that was constructed in accordance with the present invention. While two radiating elements are shown to provide two bands of operation, additional radiating elements would allow antenna 200 to operate at still additional frequencies.

Figure 4:
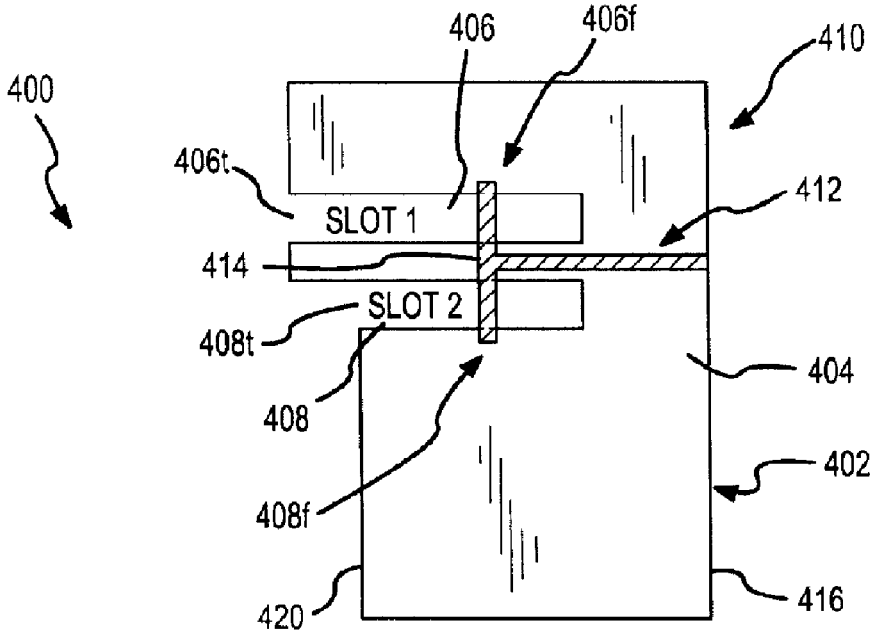
FIG. 4 is a simplified diagram of another antenna consistent with an embodiment of the present invention.

While antenna 200 is a satisfactory antenna and an improvement over prior art designs, the size of antenna 200 could be reduced. In particular, FIG. 4 shows a half slot antenna 400. Half slot antenna 400 is shown on a substrate 402 (but substrate 402 is not necessary for the present invention). Further, while antenna 400 is referred to as half slot antenna 400, one of ordinary skill in the art will recognize on reading the disclosure that half slot is used generically and the present invention should not be limited by the term half. Antenna 400 comprises a ground plane 404, a first radiating element 406, and a second radiating element 408. First radiating element 406 has a feed end 406*f* and a terminating end 406*t*. Second radiating element 408 has a feed end 408*f* and a terminating end 408*t*.

A feed connection 410 is coupled to each of first radiating element 406 and second radiating element 408 proximate or at feed ends 406*f* and 408*f*, respectively. Feed connection 410 comprises a microstrip feed line 412 and a tee connection 414 originating from a feed edge 416 of ground plane 404. Feed line 412 and tee connection 414 are similar to the devices described in connection with FIG. 2 and will not be re-explained in conjunction with FIG. 4. Ground plane 404 has a radiating edge 420 opposite feed edge 416. As shown, radiating elements 406 and 408 terminate at radiating edge 420 of ground plane 404. Thus, ground plane 404 can be of a reduced size. Further, assuming antenna 200 and half slot antenna 400 are designed to function at the same operating frequencies, the overall length of radiating element 406 is about ½ the overall length of radiating element 206 and the overall length of radiating element 408 is about ½ the overall length of radiating element 408 (hence the phrase half slot antenna). Thus, the overall size of antenna 400 is reduced as compared to antenna 200.

Figure 5:
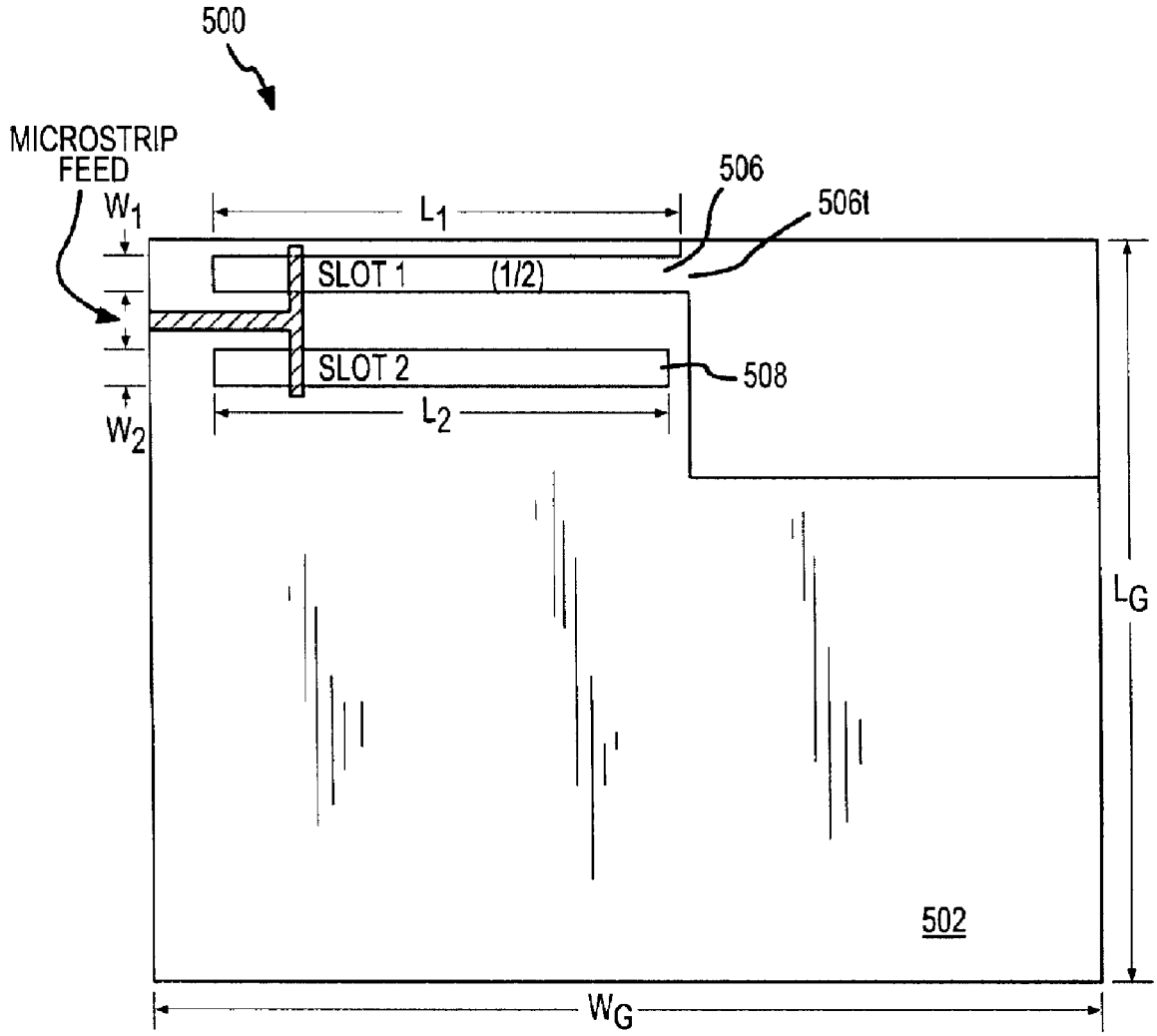
FIG. 5 is a simplified diagram of another antenna consistent with an embodiment of the present invention.

Referring now to FIG. 5, an antenna 500 is shown. Antenna 500 as a first radiating element 506 and a second radiating element 508. First radiating element 506 has a terminating end **508*t* that terminates at a radiating edge of ground plane 502. Thus, first radiating element functions similar to radiating element 406. Second radiating element 508 is situated on ground plane 502 and functions similar to radiating element 208. In other words, antenna 500 is a hybrid between antenna 200 and antenna 400. While radiating element 508** could be the half slot element, it makes more design sense to have the lower frequency element as the half slot because the lower frequency element requires a greater length than the higher frequency element.

While the invention has been particularly shown and described with reference to an embodiment thereof, it will be understood by those skilled in the art that various other changes in the form and details may be made without departing from the spirit and scope of the invention.

What is claimed is:

1. A multiband antenna, comprising:

a ground plane;

a first slot radiator of a first length, the first slot radiator having a first feed end and a first terminating end;

a second slot radiator of a second length, the second slot radiator having a second feed end and a second terminating end;

a single power feed directly feeding power without to the first slot radiator and the second slot radiator, the single power feed having a source end and a radiator end, the single power feed connectable to a single power source on the source end and having a first branch connected the first feed end and a second branch connected to the second feed end at the radiator end; and at least a first ground coupled to the single power feed proximate the first slot radiator and a second ground coupled to the single power feed proximate the second slot radiator, wherein the multiband antenna radiates at multiple frequencies.

2. The antenna of claim 1, further comprising an end extension, the end extension connected to a terminating end selected from the group of terminating ends consisting of the first terminating end and the second terminating end.

3. The antenna of claim 1, wherein the first slot radiator is straight.

4. The antenna of claim 1, wherein the second slot radiator is straight.

5. The antenna of claim 4, wherein the first slot radiator is substantially parallel to the second slot radiator.

6. The antenna of claim 5, wherein the first slot radiator and the second slot radiator reside substantially in the same plane.

7. The antenna of claim 1, wherein the first length is longer than the second length.

8. The antenna of claim 1, further comprising a dielectric substrate between the ground plane, and the first slot radiator and the second slot radiator.

9. The antenna of claim 1, wherein the single power feed comprises a microstrip feed line and the first branch and the second branch form a T.

10. The antenna of claim 1, wherein the single power feed comprises a microstrip feed line and the first branch and the second branch form a Y.

11. The antenna of claim 2, wherein the end extension comprises an L shape.

12. A multiband antenna, comprising:

a ground plane; the ground plane having an open termination edge and a feed edge;

a first slot radiator of a first length, the first slot radiator having a first feed end and a first terminating end; the first terminating end being substantially aligned with the open termination edge;

a second slot radiator of a second length, the second slot radiator having a second feed end and a second terminating end; the second terminating end being substantially aligned with the open termination edge; and a single power feed, the single power feed connectable to a single power source, the single power feed having a source end being substantially aligned with the feed edge and a radiator end, the radiator end having a first branch connected the first feed end and a second branch connected to the second feed end, wherein the multiband antenna radiates at multiple frequencies.

13. The antenna of claim 12, wherein the first slot radiator and the second slot radiator are substantially straight.

14. The antenna of claim 12, wherein the first length is longer than the second length.

15. The antenna of claim 12, wherein the single power feed comprises a microstrip feed line and the first branch and the second branch for form a T joint.

16. A multiband antenna, comprising:

a ground plane; the ground plane having an open termination edge and a feed edge;

a first slot radiator of a first length, the first slot radiator having a first feed end and a first terminating end;

a second slot radiator of a second length, the second slot radiator having a second feed end and a second terminating end; and a single power feed, the single power feed connectable to a single power source, the single power feed having a source end being substantially aligned with the feed edge and a radiator end, the radiator end having a first branch connected the first feed end and a second branch connected to the second feed end;

the first branch having a first short connected to the ground plane and the second branch having a second short connected to the ground plane, wherein the multiband antenna radiates at multiple frequencies.

17. The antenna of claim 16, wherein the first terminating end substantially aligns with the open termination edge.

18. The antenna of claim 17, wherein the second terminating end substantially aligns with the open termination edge.

19. The antenna of claim 17, where the first slot radiator radiates at a lower frequency than the second slot radiator.

20. The antenna of claim 16, wherein the first slot radiator and the second slot radiator are substantially straight.

* * * * *

UNITED STATES PATENT AND TRADEMARK OFFICE

CERTIFICATE OF CORRECTION

PATENT NO. : 7,129,902 B2
APPLICATION NO. : 10/906184
DATED : October 31, 2006
INVENTOR(S) : Bancroft It is certified that error appears in the above-identified patent and that said Letters Patent is hereby corrected as shown below:

CLAIM 1, Column 3, line 40: replace "power without to the" with "power to the"

Signed and Sealed this

Sixteenth Day of March, 2010

David J. Kappos

David J. Kappos
*Director of the United States Patent and Trademark Office*